US006217668B1

(12) United States Patent
Czech et al.

(10) Patent No.: US 6,217,668 B1
(45) Date of Patent: Apr. 17, 2001

(54) REFURBISHING OF CORRODED SUPERALLOY OR HEAT RESISTANT STEEL PARTS

(75) Inventors: Norbert Czech, Dorsten (DE); Adrian Kempster, Huntingdon (GB)

(73) Assignees: Siemens Aktiengesellschaft, Munich (DE); Diffusion Alloys Ltd., Hatfield (GB)

( * ) Notice: Subject to any disclaimer, the term of this patent is extended or adjusted under 35 U.S.C. 154(b) by 0 days.

(21) Appl. No.: 08/190,173

(22) PCT Filed: Jul. 17, 1992

(86) PCT No.: PCT/EP92/01636

§ 371 Date: Jan. 31, 1994

§ 102(e) Date: Jan. 31, 1994

(87) PCT Pub. No.: WO93/03201

PCT Pub. Date: Feb. 18, 1993

(30) Foreign Application Priority Data

Jul. 29, 1991 (GB) ..... 9116332

(51) Int. Cl.[7] ..... C23G 1/02; C23G 1/08

(52) U.S. Cl. ..... 134/3; 134/7; 427/292; 427/328; 427/331

(58) Field of Search ..... 134/1, 2, 3, 4, 134/6, 7; 427/292, 328, 331; 148/240, 241, 283; 428/610, 652, 653, 680, 681

(56) References Cited

U.S. PATENT DOCUMENTS

| | | | |
|---|---|---|---|
| Re. 30,995 | 7/1982 | Rairden, III | 428/680 |
| 4,024,294 | 5/1977 | Rairden, III | 427/42 |
| 4,080,486 | 3/1978 | Walker et al. | 428/653 |
| 4,098,450 | 7/1978 | Keller et al. | 228/119 |
| 4,339,282 | 7/1982 | Lada et al. | 134/3 |
| 4,555,612 | 11/1985 | Collins et al. | 219/130.32 X |
| 4,677,034 | 6/1987 | Luthra | 428/678 |
| 4,774,149 | 9/1988 | Fishman | 428/680 |
| 4,965,095 * | 10/1990 | Baldi | 427/142 |

FOREIGN PATENT DOCUMENTS

| | | |
|---|---|---|
| 28 10 598 | 3/1980 | (DE) . |
| 2 021 543 | 7/1970 | (FR) . |
| 1 591 436 | 3/1978 | (GB) . |

OTHER PUBLICATIONS

Proceedings of Conference on Life Assessment and Repair Phoenix, AZ, Apr. 17–19, 1990, pp. 323–334.

Proceedings of Conference on Life Assessment and Repair Phoenix, AZ, Apr. 17–19, 1990, pp. 335–350.

* cited by examiner

*Primary Examiner*—Sean Vincent
(74) *Attorney, Agent, or Firm*—Herbert L. Lerner; Laurence A. Greenberg; Werner H. Stemer

(57) ABSTRACT

A corroded superalloy or heat resistant steel part, in particular a gas turbine component like a gas turbine blade, having a surface with products or corrosion is refurbished. The invention the surface is cleaned, in particular mechanically or chemically, and an aluminide coating is applied to the cleaned surface. Subsequently, the aluminide coating is removed, whereby all products of corrosion which have still remained in the part to be refurbished are removed as well.

21 Claims, 3 Drawing Sheets

REFURBISHING OF CORRODED SUPERALLOY OR HEAT RESISTANT STEEL PARTS

This invention relates to the refurbishing of superalloy or heat resistant steel parts which have been corroded by hot gases. Such parts includes blades from stationary gas turbines as well as from marine—and aeroengines as well as exhaust valves in diesel engines and similar parts.

Parts subjected in operation to hot gases are usually made of base materials like superalloys or heat resistant steels, to which base materials protective coatings may be applied. Typical of such parts are the blade and vanes of stationary gas turbines made from superalloys which generally operate at a temperature up to 1000° C., in particular within a temperature range between 650° C. and 900° C.

The term superalloy is well known in the art and is used to describe an alloy developed for service at elevated temperatures where severe mechanical stressing is encountered and where surface stability frequently is required.

All these superalloys usually consist of various formulations made from the following elements, namely iron, nickel, cobalt and chromium as well as lesser amounts of tungsten, molybdenum, tantalum, niobium, titanium and aluminum, Nickel-chromium, iron-chromium and cobalt-chromium alloys containing minor quantities of the other elements are representatives of such superalloys. For example, such superalloys may contain, by weight, approximately 12–35% chromium and up to 80% nickel together with additives in minor amounts such as titanium, tungsten, tantalum and aluminum. Representative alloys of this type are those identified as In 738 Lc and In 939 as well as Udimet 500. These designations are known in the art.

Such parts as those referred to above may also be made of heat resistant steel. By heat resistant steel is meant an alloy based on iron with alloying elements present to improve the anti-scaling resistance of the alloy surface to high temperature oxidation. These alloying elements generally include chromium, aluminum, silicon and nickel.

Parts made of such a superalloy or of heat resistant steel may be provided with protective coatings such as diffused chromium by chromising or diffused aluminum by aluminizing or with overlay coatings of any desired composition deposited by plasma spraying or physical vapour deposition, for instance.

Even such parts with protective coatings are subject to corrosion on their exposed surfaces and may have to be refurbished in order to keep them useful for a sufficiently long service life.

Thus, turbine blades generally have to be refurbished after certain periods during their service life, which may be up to 100,000 hours.

Corrosion on gas turbine components and the like at high temperatures results from contaminants in the fuel and/or air; furthermore, oxidation may also occur at high temperatures. Depending on the conditions of operation, an oxide layer of varying thickness may form on the surface of the part, e.g., the turbine blade. Also, and very significantly, sulphur can penetrate into the base material, especially along the grain boundaries, to form sulphides deep in the material. Also, internal oxides and nitrides may form within the metal near the surface.

Refurbishing or reconditioning involves the removal of all corrosion products derived from the base material and/or the coating, optionally followed by the application of a new protective coating on the newly exposed surface of the blade.

With regard to the types of corrosion described above, it is necessary when removing all the corrosion products to remove all the deep inclusions, such as sulphides, because if these inclusions were allowed to remain, there would be a risk that during subsequent heat treatment and further operation they might diffuse into the base material—especially in the case of thin-walled components—and thus endanger its mechanical integrity. Also, there is a danger that the application of a new coating might be disturbed or made impossible.

In the present invention relating to a turbine blade or the like made of superalloy or heat resistant steel and optionally provided with a protective coating the surface of the corroded part is removed or stripped by a combination of mechanical treatment (e.g. abrasive blasting) and chemical treatment (e.g. etching with acids or other suitable agents). More recently, a high temperature treatment with fluoride chemicals which generate hydrogen fluoride as the active species has proved useful. In this treatment, aluminum and titanium oxides and nitrides which are otherwise highly resistant are converted into gaseous fluorides which in their turn are easily removed. This treatment is in particular widely used in preparation of components for repair welding and brazing.

There are, however, problems associated with the use of fluorine compounds. The first problem is environmental both within the workplace and elsewhere. The second problem is that the treatment has the disadvantage that it has no effect on sulphur occlusions, so that the grain boundary sulphides mentioned above cannot be removed by such treatment. Accordingly, it is necessary to grind the affected areas by hand which can lead to uncontrolled removal of material.

In an article entitled "Refurbishment Procedures for Stationary Gas Turbine Blades" by Bürgel et al (Bürgel, Koromzay, Redecker: "Refurbishment Procedures for Stationary Gas Turbine Blades" from proceedings of a conference on "Life Assessment and Repair", edited by Viswanathan and Allen, Phoenix, Ariz., Apr. 17–19, 1990) reference is made to an aluminizing treatment of as received service-exposed blades prior to stripping in order to make stripping of the coating easier by chemical means. The aluminum coating is applied by a pack cementation process, as normally used to apply aluminum diffusion coatings. This procedure is said to imply a high temperature treatment which leads to an enhanced inward diffusion of elements of the residual coating. It is also said that almost the whole wall thickness of the cooled blades is influenced at the leading edge and that microstructure deteriorations which are definitely not due to service exposure of the blades occur. The treatment is said to be a negative example of what can happen during stripping.

U.S. Pat. No. 4,339,282 discloses a method and composition for removing aluminide coatings from nickel superalloys, which nickel superalloys may in particular form turbine blades. Removal of an aluminide coating is accordingly done by etching with a special composition which avoids attacking the nickel superalloy. Besides a brief statement that a coating to be removed may be deteriorated, there is no specific disclosure on corrosion problems and the efficient removal of products of corrosion from a nickel superalloy substrate.

In accordance with the foregoing, it is the primary object of the invention that a corroded surface of a superalloy or heat resistant steel part may be removed effectively by deposition of an aluminide coating on the component, the depth of the coating being such as to enclose all the products of corrosion, and removal of the aluminide coating, whereby the products of corrosion are removed as well.

The inventive process for the refurbishing of a corroded superalloy or heat resistant steel part having a surface with products of corrosion comprises cleaning the surface, subsequently applying an aluminide coating on said surface and removing said aluminide coating together with the products of corrosion.

By this method, substantially all the products of corrosion, including grain boundary sulphides, can be removed.

It has been found by contrast to the teaching of the document by Bürgel et al cited above that the aluminization of the surface of a part which has become corroded by hot gases can be carried out to give the advantages described above if the surface is cleaned before aluminizing and the aluminizing is carried out as explained herein.

After removal of the aluminide coating the part may be recoated with a protective coating, for example by diffusion, in particular by chromising, plasma spraying or physical vapour deposition.

In another aspect of the invention there is provided a corroded superalloy or heat resistant steel part having a surface with products of corrosion, which surface has been cleaned and to which surface an aluminide coating has been applied subsequently, whereby substantially all products of corrosion are removed as the aluminide coating is removed.

In a further aspect of the invention there is provided a process for the production of a refurbished superalloy or heat resistant steel part having a surface with products of corrosion, which comprises cleaning the surface and subsequently applying an aluminide coating thereto and removing the aluminide coating together with the products of corrosion optionally with subsequent application of a protective coating.

The aluminide coating which is applied to the cleaned part should advantageously enclose subsequently all corrosion products which have remained after cleaning, in particular the deep corrosion products such as grain boundary sulphides. The aluminide coating is preferably of a thickness greater than 150 $\mu$m and in particular within the range of 200–400 $\mu$m, although it may be thicker.

As indicated, the surface of the corroded part to be aluminized is to be cleaned before it is aluminized. This cleaning is to remove a substantial part of the corroded surface, in particular including a substantial fraction of the products of corrosion at the surface, before it is aluminized. This cleaning can be accomplished by chemical means such as aqueous acid pickling. However, the preferred method of cleaning is by physical means, such as by using compressed air to blast the corroded surface of the nickel alloy with small particles of a hard ceramic such as aluminum oxide. These particles, by hitting and abrading the surface, can remove the majority of the products of corrosion. This cleaning is therefore essentially a procedure by which the surface corrosion products which are products of corrosion constituting part of the surface are substantially removed prior to the aluminizing treatment. These surface corrosion products comprise mainly bulky oxides which may easily be removed by mechanical treatment of the type referred to.

Figure 1:
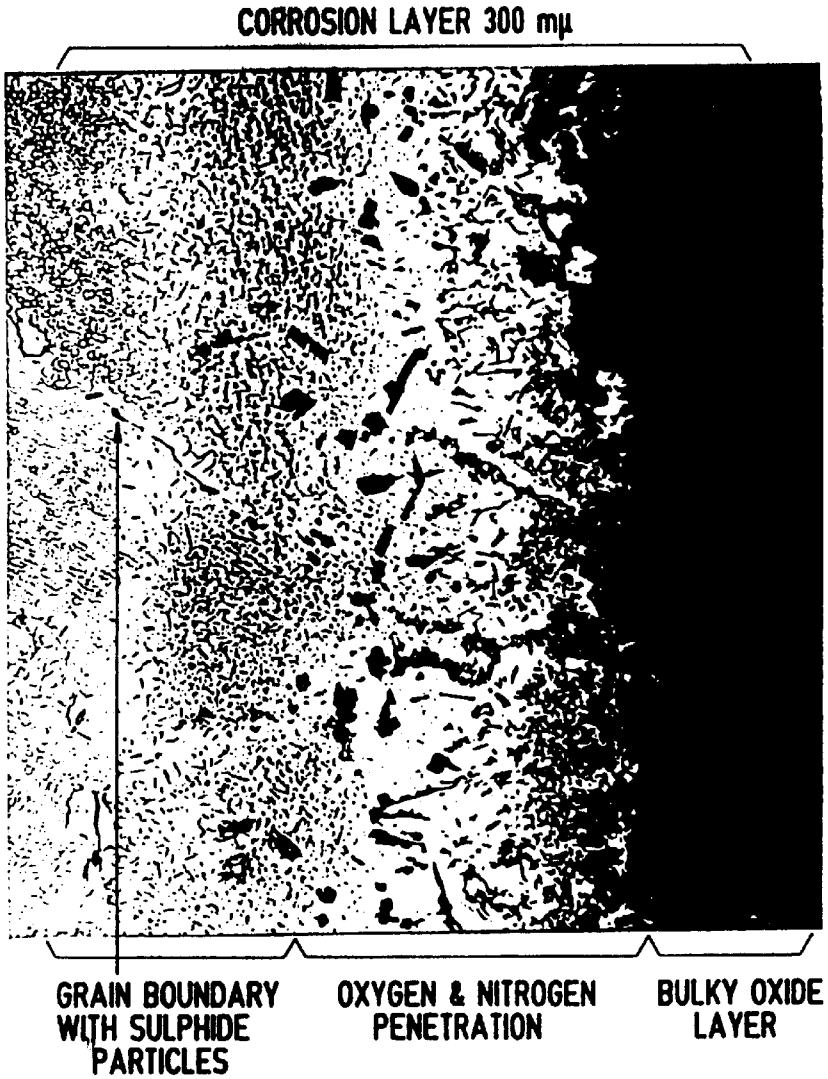
FIG. 1 is a photomicrograph of a blade section before treatment.

The aluminization of the superalloy or heat resistant steel part which has been cleaned may be carried out in a number of ways.

In a first method, the part to be aluminized is immersed in an aluminizing pack that may contain an aluminum source, a moderator (which is optional), an energizer and a diluent. The pack and the part to be aluminized are contained within a partially sealed retort which is heated in a furnace. This method is referred to as "pack aluminizing".

In a second method, the part to be aluminized and the aluminizing preparation are contained within a partially sealed retort but not in immediate contact with each other. This method of aluminizing is sometimes referred to as "out of pack" aluminizing.

In a third method, the aluminum source or generator is outside the retort and an aluminum compound, normally an aluminum halide, is passed into the heated retort, containing the part to be aluminized. This method is sometimes referred to as "gas phase aluminizing".

The source for the aluminum which is to be deposited on the surface of the superalloy can be a metallic powder or flaky preparation or a volatile chemical compound such as an aluminum halide or a chemical compound that on decomposition produces an aluminum halide. It is important during the coating operation that the aluminum, together with all other ingredients and the components contained within the aluminizing pack, is protected from attack by atmospheric oxygen with an inert atmosphere that may be produced by ammonium salts contained in the pack which decompose as the temperature is elevated. Alternatively, such protection can be produced by passing hydrogen or a hydrogen-containing gas mixture into the retort.

In general, a process of pack aluminizing as referred to above can be carried out by using two different methods. In the first method, the pack contains the aluminum source, a diluent refractory such as alumina or titania and a chemical energizer such as ammonium fluoride or ammonium chloride. The aluminizing temperature is generally in the range between 700° C. and 900° C. and the coating referred to as the aluminide coating is formed by a diffusion of aluminum. Such aluminide coating has two zones, one of which is below the original surface of the superalloy and is referred to as the "diffusion zone", and one of which is above the original surface and is referred to as the "additive zone". On parts containing nickel as a primary compound, the additive zone is a compound generally of the formula $Ni_2Al_3$. In the type of aluminizing just referred to, the depth of diffusion of aluminum into the substrate is restricted by the relatively low temperature used. Therefore, the coating consists predominantly of the additive zone (i.e. $Ni_2Al_3$).

Aluminizing packs of the type described above are referred to as "high activity packs".

It has been found that in using packs of this type to achieve coatings of a suitable depth (i.e.>150 $\mu$m), it is necessary to carry out a subsequent high temperature re-diffusion process, which may be undesirable for operational reasons. The re-diffusion process must be carried out in an inert atmosphere or vacuum furnace at around 1050–1100° C., which increases the overall cost and time for the operation. Attempts to produce thicker aluminide coatings using high activity packs at temperatures higher than 900° C. produce layers that are non-uniform over the surface of the coated parts.

In a variation of the above pack aluminizing method, a moderator is added to the pack in the form of a metal powder such as chromium, nickel or iron. The moderator reduces the vapour pressure of the aluminum halide in the pack at a temperature of aluminizing and hence allows higher temperatures to be used to achieve deeper aluminide coatings.

In this way an aluminide coating having a thickness of more than 150 μm may be prepared.

No re-diffusion process is needed by using a pack of a composition described below and termed "low activity pack". Furthermore aluminide coatings produced with low activity packs generally show an increased uniformity in comparison with aluminide coatings produced with high activity packs. It is therefore preferred according to the invention to use low activity packs.

Aluminizing packs of the low activity type have the following compositions.

Aluminum Source

| | |
|---|---|
| Concentration of aluminum | 1–25% by weight |
| preferably | 2–15% by weight |

For aluminization, an aluminum halide is preferably generated in situ within the retort and in the pack surrounding the component being aluminized. However, it is recognised that the aluminizing compound (aluminum halide) can be generated in a section of the rotort that is separate from the component being aluminized or, in fact, passed into the heated retort from an outside generator.

Moderator

This can be a metal powder addition to the aluminizing pack such as chromium, nickel or iron, of concentrations between 1–20% by weight, the preferred addition being chromium in the concentration range 2–10% by weight.

Energizer

The energizer used for the aluminizing process is generally a compound that contains a halide element such as sodium chloride or ammonium fluoride. The preferred halide compound in the process of the invention is an ammonium salt such as ammonium chloride in the concentration range 0.05–10% by weight, the preferred range about 0.1–5% by weight.

Diluent

A diluent is generally a refractory oxide powder that makes up the balance of the ingredients in the aluminizing pack and can be a compound such as $Al_2O_3$ (alumina), $TiO_2$ (titania), MgO or $Cr_2O_3$. The preferred refractory diluent used in the pack according to the invention is alumina.

The aluminization is advantageously carried out at temperatures and within time intervals which are matched to requirements to achieve aluminide coatings which enclose the corrosion products to be removed to a sufficient degree, keeping in mind that such enclosure is at least partly accomplished by diffusion of aluminum within the corroded base material.

In general, the aluminization is carried out at temperatures between 1050° C. and 1200° C., in particular between 1080° C. and 1150° C.; the same temperature ranges are to be applied in a re-diffusion treatment following an aluminization by a high activity pack. However, the temperature should always be kept well below the solution temperature of the base material alloy.

An aluminization and/or a re-diffusion process is advantageously accomplished within a time interval between 6 hours and 24 hours, in particular between 10 hours and 16 hours. However, the duration of such time interval is to be counted from reaching the desired temperature, since a heating interval preceding an aluminization process may well amount up to several hours.

Both the operating temperature and the time interval are critical parameters for the processes just referred to; however, the most critical parameter is the temperature, as indicated above.

With regard to the aluminization processes just described, the invention is not intended to be limited to the details shown. In particular, the aluminization process may advantageously be modified to be carried out with minor amounts of other elements added to the aluminum to be deposited. Such elements are silicon and chromium, for example, as they may, by a so-called "co-diffusion process", enhance the diffusion of aluminum in the base material and thus improve the enclosure of corrosion products. In any case, the choice of additional elements to be co-diffused with aluminum should be done with regard to the interaction between these elements and the base material which is to be aluminized. Normally, additions of other elements will be limited to amounts of several weight percents. The addition of these elements may in particular be accomplished by using an appropriate aluminium alloy in an aluminizing pack instead of substantially pure aluminum.

After the component has been aluminized the aluminide coating may then be removed by a suitable treatment by mechanical and/or chemical means, for example by acid pickling and/or ceramic blasting whereby all the corrosion products are simultaneously removed. Mechanical and/or chemical means may be essentially used more than once. The cleaned refurbished component can then have a protective coating applied thereto, for example by chromising.

The following Examples illustrate the invention: (In all these examples the parts to be aluminized are embedded in the pack, in the retort, which is partially sealed and placed in the furnace).

The compositions of In 738 Lc, Udimet 500 and In 939 (referred to above) are given below:

CHEMICAL COMPOSITIONS

| | In 738 Lc % | U 500 % | In 939 % |
|---|---|---|---|
| C | 0.1 | 0.08 | |
| Cr | 16.0 | 19.0 | 22.5 |
| Co | 8.5 | 18.0 | 19.0 |
| Mo | 1.75 | 4.0 | |
| W | 2.6 | | 2.0 |
| Nb | 0,9 | | 1.0 |
| Ti | 3.4 | 2.9 | 3.7 |
| Al | 3.4 | 2.9 | 1.9 |
| Ta | 1.75 | | 1.4 |
| Fe | | 4.0 max | |
| B | | 0.006 | |
| Zr | | 0.05 | |
| Ni | Balance | Balance | Balance |

EXAMPLE 1

A section of a turbine blade, made from the nickel-based alloy In 738 Lc, coated by chromising, with a maximum depth of corrosive attack of 220 μm, which have been cleaned by ceramic blasting, was subjected to the following aluminizing process.

Aluminizing compound: 3.0% aluminum; 3.0% chromium; 0.5% ammonium chloride; balance alumina Aluminizing temperature: 1110° C. for 10 hours Resulting aluminum penetration depth: 240–260 μm

EXAMPLE 2

A section of a turbine blade made from the nickel-based alloy Udimet 500, coating by chromising, with a maximum depth of corrosive attack of 180 μm, which had been roughly cleaned as in Example 1, was subjected to the following aluminizating process.

Aluminizing compound: as example (1)

Aluminizing temperature: 1080° C. for 10 hours

Resulting aluminum penetration depth: 190–220 μm

EXAMPLE 3

A section of a turbine blade made from the nickel-based alloy In 738 Lc, with a maximum depth of corrosive attack of 210 μm, and which had been roughly cleaned as in Example 1, was subjected to the following aluminizating process.

Aluminizating compound: 7.5% aluminum, 5.0% chromium; 1.0% ammonium chloride; balance alumina Aluminizing temperature: 1110° C. for 16 hours Resulting aluminum penetration depth: 240 μm

EXAMPLE 4

A section of a turbine blade made from the nickel-based alloy In 738 Lc, with a maximum depth of corrosive attack of 180 μm, was subjected to the following aluminizing process.

Aluminizating compound: 10.0% aluminum; 3.0% chromium; 0.5% ammonium chloride; balance aluminia Aluminizing temperature: 1080° C. for 16 hours Resulting aluminum penetration depth: 200 μm

EXAMPLE 5

A section of a turbine blade which had a corroded surface layer to a depth of 200 μm, made from the nickel-based alloy In 738 Lc to which had originally been applied a protective surface layer by low pressure plasma spraying having the composition as follows: 25% Cr, 12% Al, 0.7% Y, 2.5% Ta was cleaned by ceramic blasting and was subjected to the following aluminizing process.

Aluminizating compound: 3.0% aluminum, 3.0% chromium, 0.5% ammonium chloride, balance alumina Aluminizing temperature: 1110° C. for 15 hours Resulting aluminum penetration depth: 220–230 μm

EXAMPLE 6

A section of a turbine blade which had a corroded surface layer to a depth of 200 μm, made form the nickel based alloy In 738 Lc to which had originally been applied a protective surface layer by air plasma spraying having the composition as follows: 16% Cr, 4% Si, 2% Mo, 3% B, remainder Ni was cleaned by ceramic blasting and was subjected to the following aluminizing process.

Aluminizating compound: 3.0% aluminum, 3.0% chromium, 0.5% ammonium chloride, balance alumina Aluminizing temperature: 1090° C. for 15 hours Resulting aluminum penetration depth: 230–250 μm The aluminide coating applied according to Examples 1–6 can be removed by one or both of the following techniques.

a) Aqueous acid pickling:

The aluminide coating is removed by immersing the aluminized component in a solution of a hot mineral acid (such as 20% hydrochloric acid in water) and holding until the dissolution of the aluminide coating is complete. Aqueous acid pickling is only appropriate with parts whose base material is not substantially attacked by the mineral acid compound during the time interval necessary to remove the aluminide coating.

b) Ceramic blasting:

The aluminide coating is removed by using compressed air to blast it with small particles of a hard ceramic material such as aluminum oxide. The aluminide coating is somewhat friable and readily fractures away from the surface of nickel and iron alloy which are frequently used as base materials when subjected to this treatment.

Either of the two methods described above can be used to remove the aluminide coating from the surface of a nickel or iron alloy but, in practice, a combination of the two techniques is preferred. Indeed, in removing the coating from the products of the Examples, such a combination was used, the sequence being ceramic blasting followed by acid pickling. If desired, a combination of both methods may involve multiple application of at least one of them.

The reconditioned blade from which the aluminum coating had been removed was subsequently subjected to a pack chromising procedure to provide a protective coating comprising a diffusion chromium layer.

Figure 2:
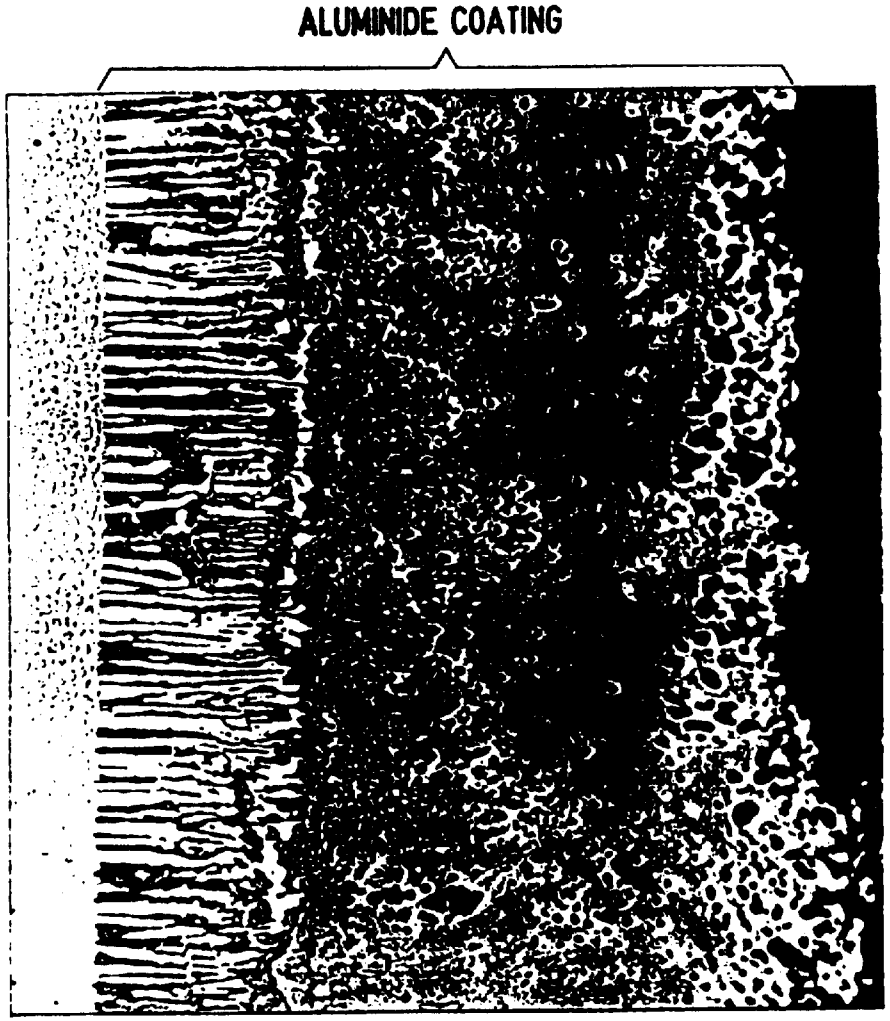
FIG. 2 is a photomicrograph of the blade section after aluminization.
Figure 3:
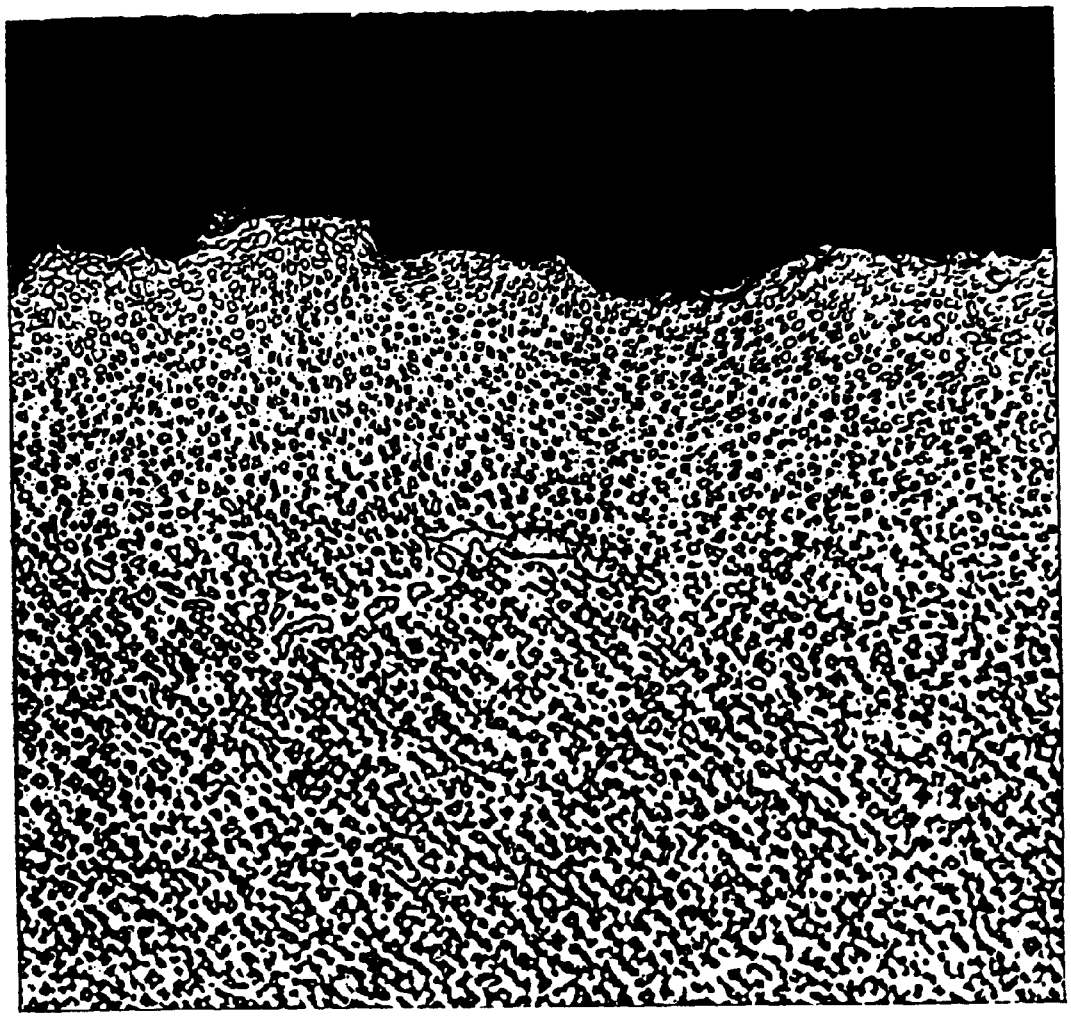
FIG. 3 is a photomicrograph of the blade section after removal of the aluminide layer.

The effectiveness of the procedure according to the invention on blade sections of chromized Ni base alloy In 738 Lc which have had 30,000 operating hours is shown in FIGS. 1–3, which are photomicrographs.

The blade section before treatment is shown in FIG. 1. The protective coating has been completely consumed by corrosion. The blade material shows corrosion up to a depth of 300 μm. The sulphide particles are visible deep in the blade section at the grain boundaries as indicated.

The blade section is then cleaned according to the invention. This removes all the products of corrosion, including bulky oxides, from the surface of the blade section.

FIG. 2 shows the blade section after aluminization The aluminide coating has encapsulated the particles produced by corrosion including the sulphide particles.

FIG. 3 shows the blade section after removal of the aluminide layer. This was carried out by blasting with ceramic (alumina) particles followed by acid pickling. The clean surface produced is readily apparent. No sulphide particles are to be seen.

What is claimed is:

1. A process for refurbishing a corroded superalloy or heat resistant steel part having a surface with corrosion products including surface corrosion products forming part of the surface and deep corrosion products deposited below the surface, which comprises:

cleaning a surface of a corroded part and removing a substantial portion of the surface including a substantial portion of the surface corrosion products;

subsequently applying an aluminide coating to the surface; and removing the aluminide coating from the part and removing the corrosion products remaining after the cleaning step from the part together with the aluminide coating.

2. The process according to claim 1, which comprises enclosing with the aluminide coating substantially all of the surface corrosion products remaining on the surface after the cleaning step.

3. The process according to claim 1, which comprises enclosing with the aluminide coating the surface corrosion products remaining on the surface after the cleaning step and enclosing with the aluminide coating the deep corrosion products deposited below the surface.

4. The process according to claim 3, which comprises enclosing with the aluminide coating deep corrosion products in the form of grain boundary sulphides.

5. The process according to claim 1, wherein the aluminide coating on the surface has a thickness greater than 150 μm.

6. The process according to claim 5, wherein the aluminide coating on the surface has a thickness greater than 400 $\mu$m.

7. The process according to claim 1, which comprises removing the surface corrosion products including bulky oxides in the cleaning step.

8. The process according to claim 1, which comprises performing the cleaning step with at least one method selected from the group consisting of chemical and mechanical cleaning.

9. The process according to claim 8, which comprises performing the cleaning step by blasting the corroded surface with ceramic particles.

10. The process according to claim 1, which comprises applying the aluminide coating by means of pack aluminizing.

11. The process according to claim 10, which comprises employing a low activity pack in the applying step.

12. The process according to claim 1, which comprises removing the aluminide coating by at least one of mechanical and chemical means.

13. The process according to claim 12, which comprises performing the removing step by at least one of ceramic blasting and acid pickling.

14. The process according to claim 1, which comprises removing the aluminide coating by mechanical means and chemical means.

15. The process according to claim 1, which comprises coating the surface of the part after the removing step with a protective coating.

16. The process according to claim 15, which comprises applying the protective coating by one of diffusion, plasma spraying and physical vapor deposition.

17. The process according to claim 16, which comprises applying the protective coating by chromizing.

18. The process according to claim 1, which comprises obtaining a refurbished superalloy or a refurbished heat resistant steel part after the removing step from a corroded superalloy or from a corroded heat resistant steel, respectively.

19. A process for producing a superalloy or heat resistant steel part from a respective superalloy or heat resistant steel part having a surface with corrosion products including surface corrosion products forming part of the surface and deep corrosion products deposited below the surface, which comprises cleaning a surface of the part and removing a substantial portion of the surface including a substantial portion of the surface corrosion products, subsequently applying an aluminide coating on the surface and removing the aluminide coating together with the corrosion products having remained in the cleaning step from the part.

20. The process according to claim 19, which comprises enclosing with the aluminide coating substantially all corrosion products remaining on the part after cleaning.

21. The process according to claim 20, which comprises coating the surface of the part with a protective coating after the aluminide coating has been removed.

* * * * *